US005899798A

United States Patent [19]

Trojan et al.

[11] Patent Number: 5,899,798

[45] Date of Patent: May 4, 1999

[54] LOW PROFILE, LOW HYSTERESIS FORCE FEEDBACK GIMBAL SYSTEM FOR CHEMICAL MECHANICAL POLISHING

[75] Inventors: Daniel R. Trojan, Phoenix, Ariz.; Lawrence L. Lee, Mountain View, Calif.

[73] Assignee: Obsidian Inc., Fremont, Calif.

[21] Appl. No.: 08/900,808

[22] Filed: Jul. 25, 1997

[51] Int. Cl.[6] ..... B24B 29/02; B24B 47/10; F16C 23/04

[52] U.S. Cl. ..... 451/259; 451/288; 451/398; 384/193; 384/206

[58] Field of Search ..... 451/285, 286, 451/287, 288, 289, 290, 398, 259; 384/193, 194, 206, 228

[56] References Cited

U.S. PATENT DOCUMENTS 3,374,582 3/1968 Boettcher ..... 451/287 X
3,698,776 10/1972 Litman et al. .
3,731,435 5/1973 Boettcher et al. ..... 451/288
3,781,071 12/1973 Kauzlarich .
3,977,130 8/1976 Degner ..... 451/288
5,618,227 4/1997 Tsutsumi et al. ..... 451/288
5,624,299 4/1997 Shendon ..... 451/28
5,643,053 7/1997 Shendon ..... 451/288 X

*Primary Examiner*—Timothy V. Eley
*Attorney, Agent, or Firm*—Morrison & Foerster LLP

[57] ABSTRACT

A low profile, low hysteresis force feedback gimbal system is provided to greatly reduce the generation of moments about a pivot point of the gimbal system during polishing processes. A load cell is placed directly above a contact pin of the gimbal system to provide a very accurate feedback measurement of the amount of downward load applied to a substrate during polishing.

22 Claims, 6 Drawing Sheets

LOW PROFILE, LOW HYSTERESIS FORCE FEEDBACK GIMBAL SYSTEM FOR CHEMICAL MECHANICAL POLISHING

CROSS-REFERENCE TO RELATED APPLICATIONS

This application is related to Ser. No. 08/900,184, filed Jul. 25, 1997, entitled "Improved Wafer Carrier For Chemical Mechanical Planarization Polishing" which is hereby incorporated by reference herein in its entirety.

TECHNICAL FIELD

The present invention relates to a self-aligning pivot used in apparatuses for polishing. Among applicable polishing apparatuses, are those used in the polishing of semiconductor wafers of the type from which chips for integrated circuits and the like are made. More specifically in a chemical mechanical polishing or planarization (CMP) process a semiconductor wafer is held by a substrate carrier and is polished by contact with an abrasive material in a controlled chemically active environment.

BACKGROUND ART

As part of the manufacturing process of semiconductor devices, semiconductor wafers are polished by CMP. The uniform removal of material from and the planarity of patterned and un-patterned wafers is critical to wafer process yield. Generally, the wafer to be polished is mounted on a substrate carrier which holds the wafer using a combination of vacuum suction or other means to contact the rear side of the wafer and a retaining lip or ring around the edge of the wafer to keep the wafer centered on the substrate carrier. The front side of the wafer, the side to be polished, is then contacted with an abrasive material such as an abrasive pad or abrasive strip. The abrasive pad or strip may have free abrasive fluid sprayed on it, may have abrasive particles affixed to it, or may have abrasive particles sprinkled on it.

The ideal wafer polishing process can be described by Preston's equation:

$R=K_p*P*V$, where R is the removal rate; Kp is a function of consumables (abrasive pad roughness and elasticity, surface chemistry and abrasion effects, and contact area); P is the applied pressure between the wafer and the abrasive pad; and V is the relative velocity between the wafer and the abrasive pad. As a result, the ideal CMP process should have constant cutting velocity over the entire wafer surface, constant pressure between the abrasive pad and wafer, and constant abrasive pad roughness, elasticity, area and abrasion effects. In addition, control over the temperature and pH is critical and the direction of the relative pad/wafer velocity should be randomly distributed over the entire wafer surface.

One common type of wafer polishing apparatus is the CMP model 372M made by Westech Systems Inc. A wafer is held by a substrate carrier of the model 372M. The substrate carrier rotates about the axis of the wafer. A large circular abrasive pad is rotated while contacting the rotating wafer and substrate carrier. The rotating wafer contacts the larger rotating abrasive pad in an area away from the center of the abrasive pad.

Another related apparatus is a polishing machine for polishing semiconductor wafers containing magnetic read-write heads, disclosed in U.S. Pat. No. 5,335,453 to Baldy et al. With this machine, a semiconductor wafer is held by a substrate carrier which is moved in a circular translatory motion by an eccentric arm. The wafer is polished by contacting an abrasive strip which is advanced in one direction. The relative motion between the wafer and the abrasive strip is a combination of the circular motion of the wafer and the linear motion of the advancing abrasive strip.

While the precessing circle polishing pattern should provide more uniform velocities such that different points on the wafer see similar velocities at any given time, the velocities are still not constant. Assuming the rotation of the eccentric arm is held to a constant angular speed, the precessing circle relative motion results in fluctuating velocities. When the wafer is rotating away from the precessing direction the net relative velocity is lower, and when the wafer is rotating with precessing direction the net relative velocity is higher.

The gimbal point of a CMP substrate carrier is a critical element of the polishing process. The substrate carrier must align itself to the polish surface precisely to insure uniform, planar polishing results. Many CMP substrate carriers currently available yield wafers having anomalies in planarity. The vertical height of the pivot point above the polishing surface is also important, since the greater the height, the larger the moment that is induced about the pivot point during polishing. Two pervasive problems that exist in most CMP wafer polishing apparatuses are underpolishing of the center of the wafer, and the inability to adjust the control of wafer edge exclusion as process variables change.

For example, substrate carriers used on many available CMP machines experience a phenomenon known in the art as "nose diving". During polishing, the head reacts to the polishing forces in a manner that creates a sizable moment, which is directly influenced by the height of the gimbal point, mentioned above. This moment causes a pressure differential along the direction of motion of the head. The result of the pressure differential is the formation of a standing wave of the chemical slurry that interfaces the wafer and the abrasive surface. This causes the edge of the wafer which is at the leading edge of the substrate carrier, to become polished faster and to a greater degree than the center of the wafer.

The removal of material on the wafer is related to the chemical action of the slurry. As slurry is inducted between the wafer and the abrasive pad and reacts, the chemicals responsible for removal of the wafer material gradually become exhausted. Thus, the removal of wafer material further from the leading edge of the substrate carrier (i.e., the center of the wafer) experiences a diminished rate of chemical removal when compared with the chemical action at the leading edge of the substrate carrier (i.e., the edge of the wafer), due to the diminished activity of the chemicals in the slurry when it reaches the center of the wafer. This phenomenon is sometimes referred to as "slurry starvation".

Apart from attempts to reshape the crown of the substrate carrier, other attempts have been made to improve the aforementioned problem concerning "nose diving". In a prior art substrate carrier that gimbals through a single bearing at the top of the substrate carrier, sizable moments are generated because the effective gimbal point of the substrate carrier exists at a significant, non-zero distance from the surface of the polishing pad. Thus, the frictional forces, acting at the surface of the polishing pad, act through this distance to create the undesirable moments.

U.S. Pat. No. 5,377,451 to Leoni et al. describes a wafer carrier that "projects" the effective gimbal point down to the surface of the polishing pad, thereby eliminating the moment arm through which the frictional forces create the undesirable "nose diving". Leoni et al. produce this effect by instituting a conical bearing assembly which allows the projection of a "universal pivot point" to a point that is located at or near the surface of the polishing surface. The solution proposed by Leoni et al., however, requires the use of a number of bearings in the assembly in order to effect this projection, thereby increasing the cost of the wafer carrier. Additionally, there is still a moment produced because of the actual contact points at the bearings. There is also a substantial risk that, due to inexact manufacturing, the projected pivot point will not lie exactly on the contact surface of the carrier, which will also introduce moments.

DISCLOSURE OF THE INVENTION

The present invention includes a novel substrate carrier for polishing wafers and other substrates requiring a high degree of planarization in their manufacture. The substrate carrier made in accordance with the present invention comprises a number of improved features for effecting the above-stated goals. One advantageous feature of the present invention is the provision of a self-aligning substrate carrier having a substantial reduction, compared to standard ball gimbal systems, in the magnitudes of frictional moments produced at the substrate surface, without the need of creating a separate bearing assembly having multitudinous bearings.

Another advantage provided by the present invention is precision. Precision polishing of substrates is enhanced by lessening the occurrences of "nose-diving" by the reduction in torque moments during polishing which are achieved by the gimbal arrangements disclosed herein.

Additionally, the present invention provides a lower cost method of addressing the problems of "nose-diving" inherent in systems having a sizable moment arm inherent when the pivot point of a substrate carrier is substantially distant from the polishing surface of the substrate. The present invention moves the pivot point much closer to the polishing surface without the need for a gimbal system employing multiple bearings.

Another advantage of the present invention is the substantial elimination of force hysteresis, thereby resulting in significantly improved uniformity in planarity among substrates polished using the present invention.

Because of the low profile nature of the present substrate carrier by use of a non-rotating, hollow substrate plate, the pivot point can be placed very close to the actual polishing surface of the substrate carrier. An additional advantage gained by the non rotation of the substrate carrier, is that a load cell can be placed directly above the gimbal arrangement, allowing a much more accurate feedback measurement of the down force applied to the substrate carrier during polishing, while eliminating the force and frictional hysteresis associated with the conventional air cylinders, rotation shafts and column support bearings which generally are interpositioned between the conventional load cell and gimballing apparatus.

Other advantages and features of the present invention will become clear in the detailed description of the invention as read in conjunction with the accompanying figures.

BEST MODE FOR CARRYING OUT THE INVENTION

Figure 1:
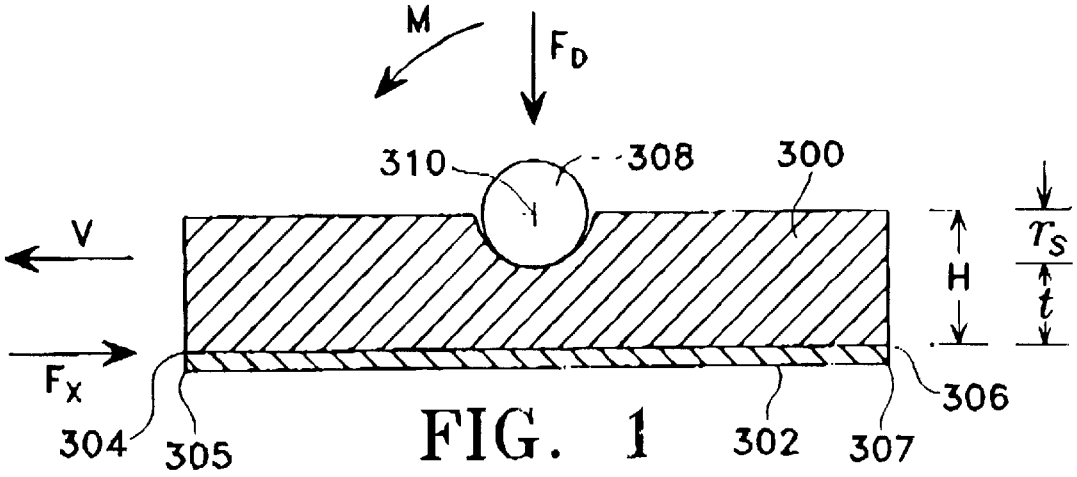
FIG. 1 (PRIOR ART)
FIG. 1 is a diagrammatic representation illustrating the contribution of a standard gimbal system to the phenomenon of "nose-diving"

The following description refers to specific embodiments by way of reference to the figures and reference numerals contained therein. The description is for purposes of satisfying disclosure requirements and is not to be limiting of the invention, which is defined by the claims below, and which includes equivalents thereof.

FIG. 1 is a diagrammatic representation illustrating the contribution of a standard gimbal system to the phenomenon of "nose-diving". Downward force $F_D$ is applied to substrate carrier 300 through gimbal ball 308 via a CMP polishing machine (not shown). The force upon substrate carrier 300 is transferred upon substrate 302 to effectuate and enhance chemical-mechanical polishing of the substrate 302. Ideally, a uniform distribution of the force $F_D$ through substrate carrier 300 is preferred, for an even application of force to substrate 302 so that the surface of substrate 302 will experience a consistent rate of polishing over all of the surface to be polished.

In reality, however, the substrate carrier 300 and substrate 302 must be moved, with respect to a polishing pad to effectuate the polishing action. Assuming substrate carrier 300 (as well as gimbal ball 308) and substrate 302 are moving in direction V in FIG. 1, there is a friction force $F_X$ generated in a direction opposite to V, caused by the interaction between the polishing surface and the bottom surface (or front side) of substrate 302. Because substrate carrier 300 is able to gimbal through a pivot point 310 in gimbal ball 308, a moment M is applied to substrate carrier 300 and thus to substrate 302. Moment M is the product of the frictional force $F_X$ times the distance from the application of frictional force $F_X$ to the point 310 at which the gimballing occurs and where the moment is generated. Specifically, this distance is defined by the height H of the substrate 302 and substrate carrier 300 in FIG. 1.

Because the thickness of the substrate 302 is substantially a constant when presented for the polishing process, and because the substrate carrier 300 very often envelopes the substrate during processing with one or another form of retaining ring, it can be stated that the moment M is substantially dependent upon the height of the substrate carrier 300 in this case. The effect of moment M is to increase the downward force applied to the leading edge 304 of substrate carrier 300 and leading edge 305 of substrate 302, and to reduce the downward force on the trailing edge 307 of the substrate 302 and trailing edge 306 of substrate carrier 300.

Figure 2:
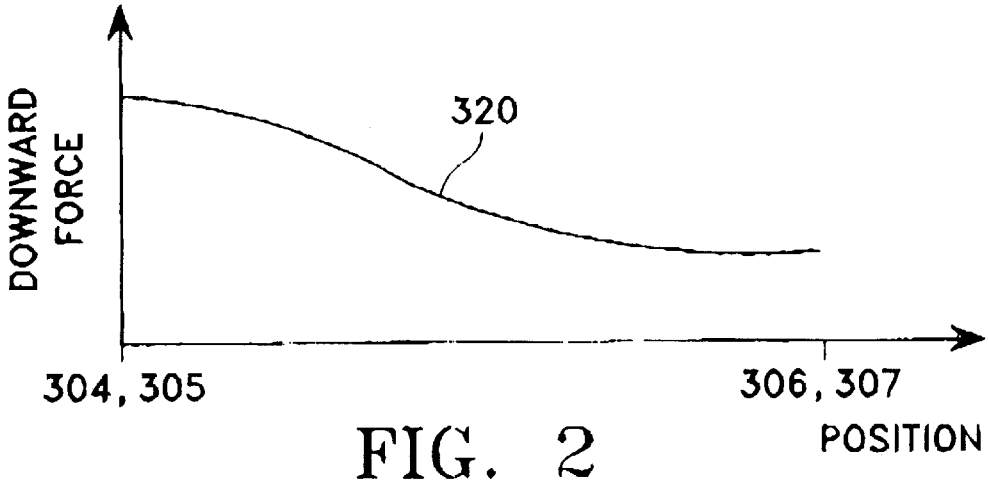
FIG. 2 (PRIOR ART)
FIG. 2 is a graphical representation illustrating the uneven force application across the polishing surface of a substrate as it experiences "nose-diving"

FIG. 2 is a graphical representation of the effect of moment M upon the downward force applied through substrate carrier 300 and substrate 302. Because of the increased force on the leading edge side, the result is that the leading edge side of the lower surface of substrate 302 experiences more wear through polishing than the trailing edge side per unit of time. The profile 320 of the force applied to the substrate 302 is proportional to the height H. This effect is problematic, since one of the goals of polishing is to obtain a perfectly planar surface on the substrate 302.

To address this problem, one way of reducing the moment M would be to reduce the height of substrate carrier 300. However, if the substrate carrier is made too thin it tends to flex under load and possibly may even fail during a polishing process. Other performance requirements make significant reduction of the height of the substrate carrier difficult to achieve, as well. A more realistic approach to reducing the height or distance H is to lower the gimbal point, i.e., by reducing the distance between gimbal point 310 and the lower surface of substrate 302.

As previously mentioned, several prior art solutions employ the use of a set of gimbal bearings that are aligned so that the "effective" pivot point can be reflected to reside on the surface of the polishing surface; thereby effectively eliminating the problem of undesirable torque. As also mentioned, this solution requires a potentially costly design to improve over the traditional "ball-and-socket" gimbal arrangement, such as that diagrammed in FIG. 1, while at the same time placing more exacting machining requirements to ensure that the projected or effective pivot point lies exactly upon the contact surface of the carrier.

Further, no inherent improvement in the pressure profile is observed beyond a reduction in H less than about 0.75 inches in the present embodiments However, reducing the force hysteresis of the load/gimbal system significantly improves the uniformity of the polished surfaces obtained from substrate to substrate, i.e., the repeatability of the process is greatly improved with the present invention.

The pivot point of a ball gimbal (i.e., ball and socket gimbal arrangement) such as that shown in FIG. 1, is defined by the point where horizontal and vertical forces intersect, i.e., the point defined by reference numeral 310 in FIG. 1. Thus, the height or distance H affecting the moments formed in this type of system must always be greater than the radius of the gimbal ball used in such a system. Specifically, $H=r_g+t$ in the example shown in FIG. 1, where $r_g$ defines the radius of the gimbal ball 308 and t defines the thickness of the substrate carrier 300 between the gimbal ball 308 and the substrate 302.

One aspect of the present invention improves over the traditional "ball-and-socket" arrangement, by removing the requirement that the lower limit of H always be greater than the radius of a gimbal ball. The present invention reduces the H dimension without the attendant increased costs due to a more complicated and numerous set of gimbal bearings.

Figure 3:
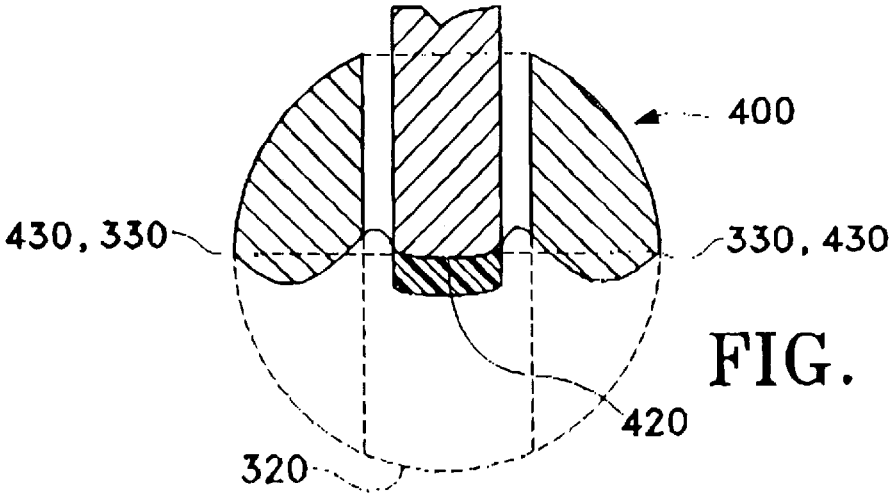
FIG. 3 is a representation of the modifications which have been made to a traditional gimbal ball to achieve a dual radius gimbal bearing according to the present invention.

FIG. 3 shows the modifications which have been made to a traditional gimbal ball (in phantom lines) to achieve a dual radius gimbal bearing according to the present invention. The theory behind the modifications is that by moving the vertical point of contact 320 of a standard gimbal ball, up to a position 420 of horizontal alignment with the contact line of action 430 (which is the same as the contact line of action 330 of the standard gimbal ball), height H of the pivot point is reduced to be equal to merely the thickness t of the substrate carrier between position 420 and the substrate 302. Since thickness t, in actuality is generally much less than 1.5 inches (e.g., about 0.600 inches), the present invention greatly reduces the amount of moment produced during chemical mechanical polishing. At the same time, the effective radius of the "ball" (i.e., puck) 400 remains large (i.e., the same as that of the standard gimbal ball) in the horizontal direction to distribute horizontal stress levels.

Figure 4A:
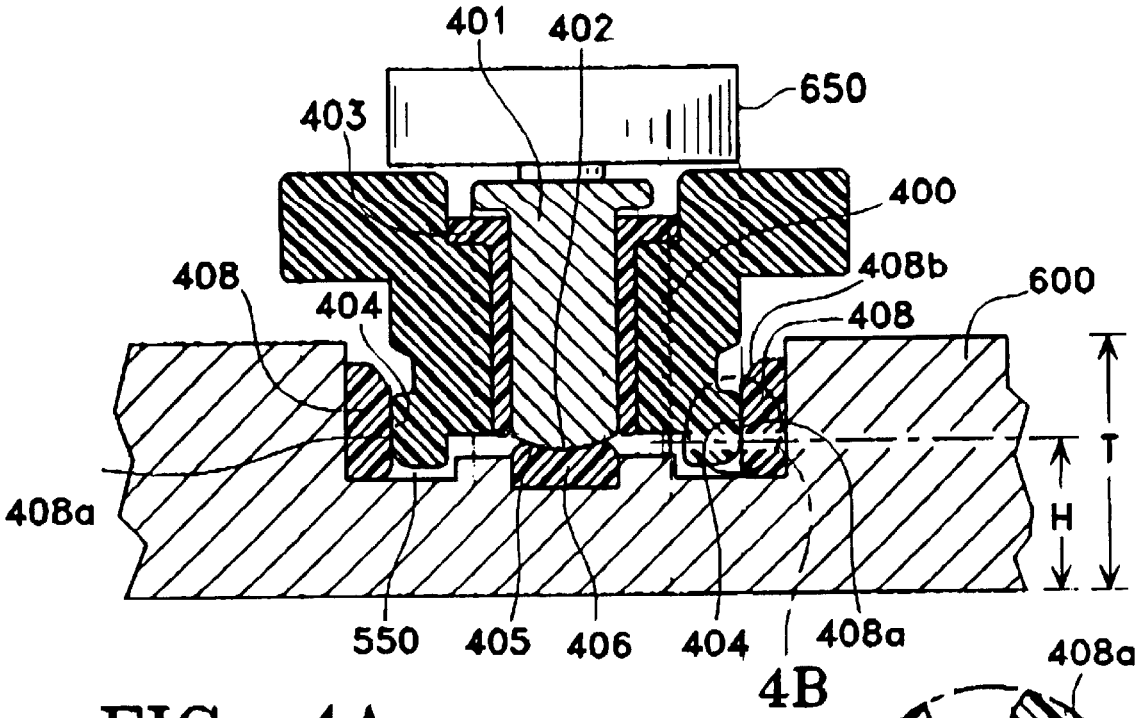
FIG. 4A is a cut-away, sectional view of a preferred dual radius gimbal bearing according to the present invention.

Because of the large down forces which are required for effective CMP polishing, a standard gimbal ball must have a fairly large radius so that the contact surface distributes the force sufficiently over a bearing surface to preclude damage to the bearing surface during down force transfer. Standard gimbal ball radiuses are on the order of 1.5 inches or even greater. Thus, an effective substrate carrier can be produced to have a thickness, at the contact point with a gimbal, which is significantly less than the diameter of a standard gimbal ball. In combination with the present invention, the result is to greatly reduce "nose-diving" effects which are attributable to the standard gimbal arrangement. The foregoing explains the resultant shape of the puck 400, which is also shown in FIG. 4A.

In the standard gimbal ball system shown in FIG. 1, the bearing surface 312 of the socket has a radius of curvature which substantially matches the radius of curvature of ball 308. Such an arrangement tends to produce sliding friction between the bearing surface and ball surface during gimballing.

Another aspect of the present invention is to significantly reduce this source of friction. For example, in the embodiment shown in FIG. 4A, the radius of curvature of the bearing surface 405 of contact button 406 is significantly larger than the radius of curvature of the vertical force gimbal surface 402, which is mounted on or integral with contact pin 401. Contact pin 401 is preferably made of the same material as puck 400, but is separately mounted therein. For example, for a vertical force gimbal surface having a radius of curvature of about 1.5 inches, a contact button having a bearing surface with a radius of curvature of about 2.0 inches could be used. Consequently, a truer rolling motion is obtained between surfaces 402 and 405 during gimballing, since a much smaller area of the gimbal surface 402 actually contacts the contact button 406 at any given gimballing attitude, as compared to the standard ball and socket type gimbal arrangement.

Figure 4B:
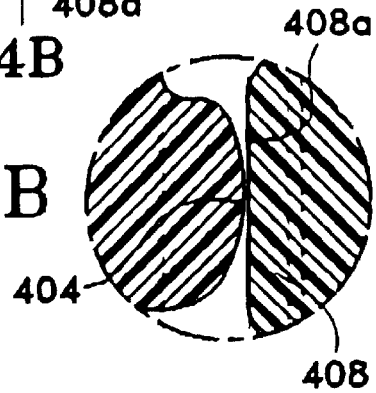
FIG. 4B is a magnified partial view which exaggerates the difference in radii of curvature between the surfaces depicted as 404 and 408*a* in FIG. 4A.

With the ball and socket having different radii, a problem arises as to the horizontal restraint on the gimbal mechanism. As shown in FIGS. 4A and 4B, horizontal force gimbal surface 404 is provided on the differential radius puck 400. A low friction ring 408 is provided for transferring lateral forces between the substrate plate 600 and the horizontal force gimbal surface 404. The surface of contact 408*a* of ring 408 is substantially cylindrical. The contact surface 404 on the other hand, has a radius of curvature that is substantially equal to the distance from the center of surface 402 to the center of the surface 404. The radius of curvature of contact surface 404 may be lesser or greater than the radius of curvature of surface 402. It is important only that the radius of curvature of surface 404 be substantially less than the radius of curvature of surface 408*a*, to obtain the same reduction in sliding friction and improvement in rolling action described above with respect to the vertical force gimbal surface. Ring 408 is preferably chamfered at 408*b* to facilitate the positioning of puck 400 within the gimbal system.

Ring 408 and contact button 406 are preferably formed of low friction plastic, which is made possible by the fairly large radii of curvature of the contact surfaces of the puck 400 and surface 402. Ring 408 and button 406 are most preferably formed of DELRIN, or another substantially equivalent linear acetyl resin. Other suitable low friction plastics include polyphenko ertalyte. Still further, other low friction materials such as ceramics may be successfully employed. The substrate plate 600 and puck 400 are preferably formed of stainless steel, more preferably hardened stainless steel, but other metals having sufficient strength and wear resistance, such as aluminum or brass, for example, may be alternatively used.

It is important to note that one of the features of the present invention is the division of the horizontal and vertical constraints on gimballing as distinguished from the traditional "ball-and-socket" arrangement where the horizontal and vertical constraints occur at the same point of contact of the ball with the socket.

Another preferred feature of the differential radius puck 400 is that the vertical and horizontal constraints (or points of contacts) are co-planar. This is the preferred embodiment for the presently claimed gimbal arrangement because if these constraint points were not co-planar, then the improvement of the effective gimbal point becomes the point furthest away from the polishing surface; thus resulting in an increase in frictional moment.

Figure 5:
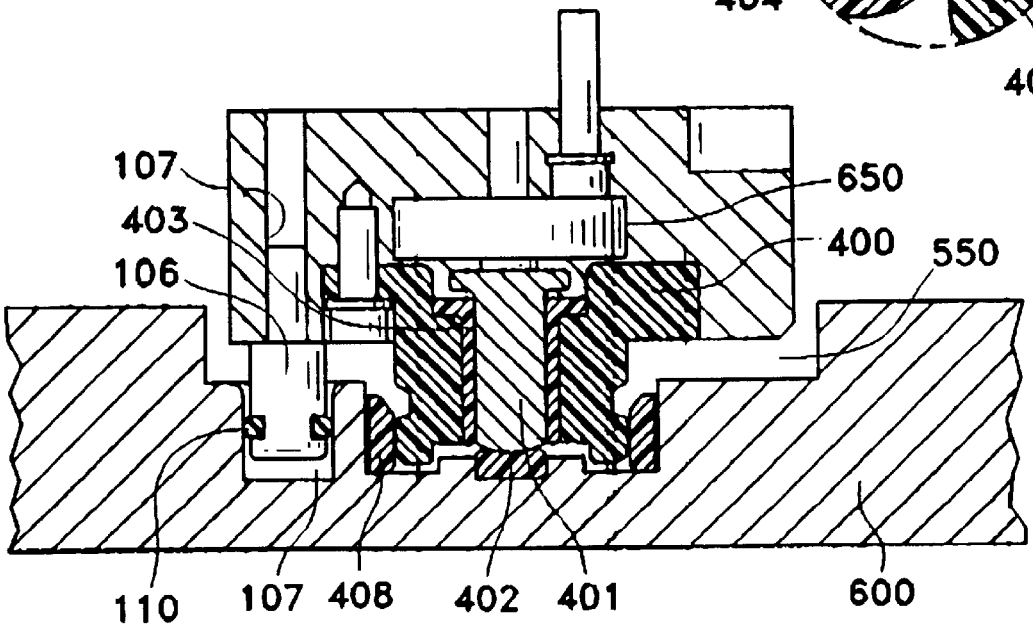
FIG. 5 is a cut-away, sectional view of the dual radius gimbal bearing shown in FIG. 4A.

FIG. 5 shows the dual radius gimbal system discussed above with regard to FIGS. 4A and 4B. Puck 400 and an upper portion of the hollow in substrate plate 600 define a socket 550 which is preferably filled with grease or other lubricant to further reduce the friction experienced during gimballing.

Contact pin 401 is slidably mounted within a low friction sleeve 403 which is fixed (preferably press fit) within puck 400. This enables an even better isolation of the vertical forces transferred between the substrate plate 600 and load cell 650 which is mounted directly on top of contact pin 401. The placement of the load cell 650 allows the system to decouple the hysteresis effects which would otherwise be generated by the load assembly components.

Further, due to the alignment of the horizontal and vertical contact forces so as to be coplanar, the effective gimbal location can be moved much closer to the actual polishing surface of the substrate plate, as indicated by H in FIG. 4A. The distance H is less than the radius of curvature of surfaces 402 and 404, which would be the. limiting distance from the polishing surface if a standard gimbal ball were to be used. Also, due to the hollow formation in the substrate plate 600, the distance H is much less than the thickness T of the substrate plate 600.

Figure 10:
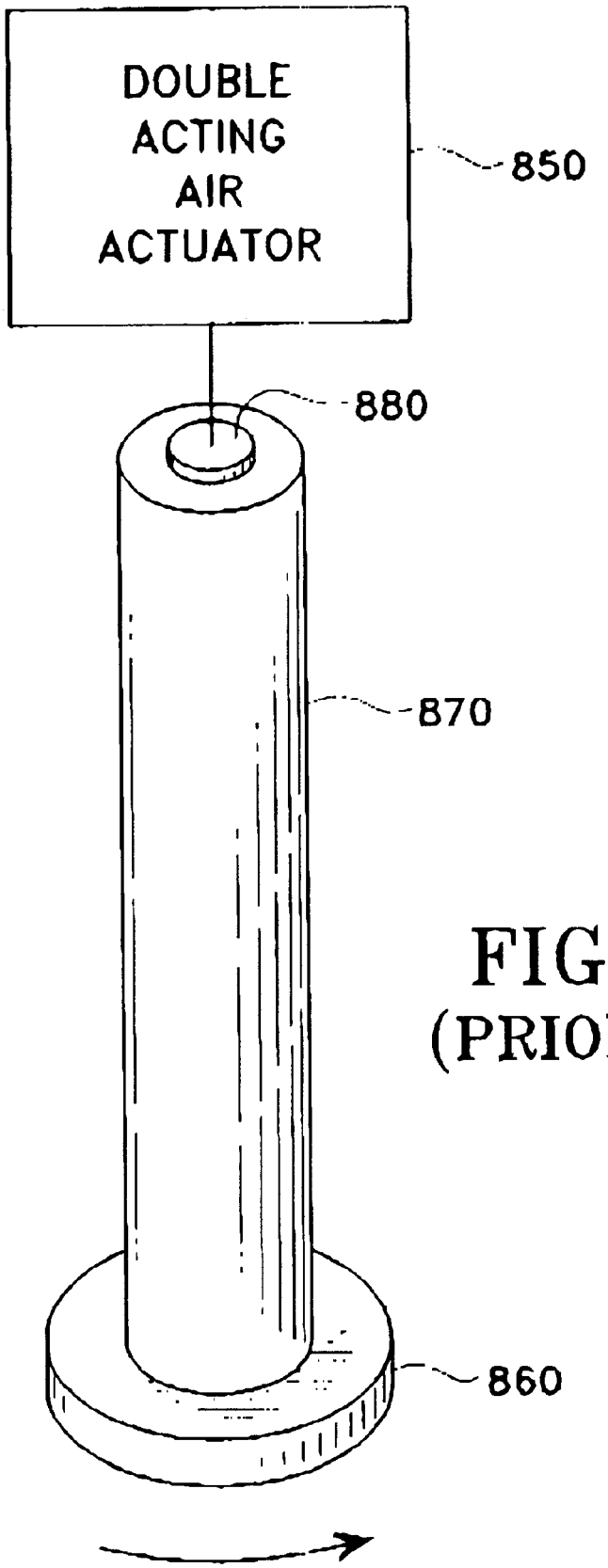
FIG. 10 (PRIOR ART)
FIG. 10 is a schematic drawing of a conventional rotary polishing apparatus.

Referring to FIG. 10, a conventional rotary substrate carrier is diagrammed. In this type of arrangement, a double acting air actuator 850 is provided for application of both vertical down force on the substrate carrier 860, as well as a rotational driving force for the substrate carrier 860. A heavy drive coupling shaft 870 is also required for transfer of the dual actions to the substrate carrier. The drive coupling shaft alone generally weighs on the order of 50 to 500 pounds. Multiple bearing mounts are required for mounting the shaft 870 between the actuator 850 and substrate carrier 860. A feedback load cell 880 is provided atop the shaft 870 for indicating a measure of the amount of vertical load which is applied to the substrate at the location of the substrate carrier 860 at any given time. However, in this type of arrangement, because the spinning, heavy shaft 870 intervenes between the load cell 880 and the actual location of the load applied to the substrate, the load cannot be directly measured on the substrate carrier 860 itself since the substrate carrier spins during processing. The location of the load cell 880 above the rotating shaft makes force measurements inaccurate, since a substantial amount of hysteresis is generated by the heavy, spinning shaft, as well as the rotation of the substrate carrier.

In contrast, the load system between load cell 650 and the actual location of the force applied to the substrate in the system according to the present invention weighs only about 5.5 pounds. Since neither the substrate plate 600 nor contact pin 401 (or gimbal 400,) rotates, the load cell 650 can be directly mounted atop the substrate plate/gimbal, thereby decoupling the hysteresis effects described above with respect to the conventional rotating substrate carrier and required shaft. Thus, a much more accurate measurement of the vertical force is obtained by the present arrangement. The same advantages are obtained in the additional embodiments which are discussed below.

Figure 6:
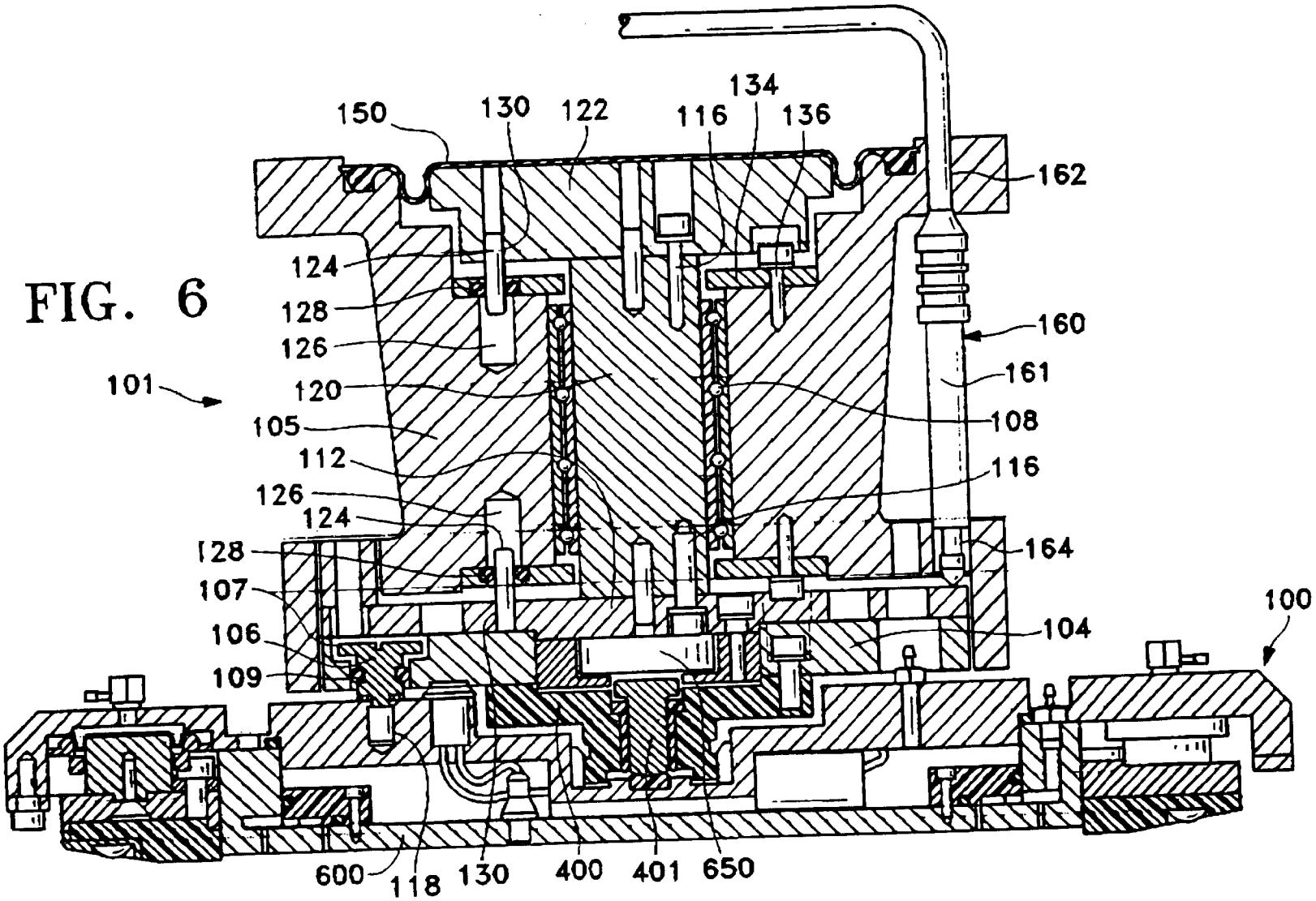
FIG. 6 is a sectional view of a substrate carrier for a CMP apparatus employing a gimbal arrangement as shown in FIG. 5.

FIG. 6 is a sectional view of a polishing apparatus 101 showing a mounted substrate carrier 100 which employs the dual radius gimbal arrangement described in FIG. 5. Substrate carrier 100 is mounted to chuck 104 which in turn is mounted to bearing housing 105 of the polishing apparatus 101. Substrate carrier mount 100 is preferably mounted to chuck 104 by bolts but other equivalent forms of mounting may be employed as would be readily apparent to those of ordinary skill in the art. Similarly, chuck 104 may be bolted, threaded or otherwise mounted to bearing housing 105.

Puck 400 is mounted to chuck 104 (preferably by bolting) and, together with contact pin 401 and the contact surfaces described above, allows substrate carrier 100 to tilt and pivot with respect to chuck 104. At least one antirotation pin 106 is provided to prevent rotation of substrate carrier 100 with regard to chuck 104. Thus, although tilting of the substrate carrier 100 with respect to chuck 104 about two axes will still be allowed by gimbal 108, the antirotation pin or pins 106 prevent any substantial rotation of substrate carrier 100 about its central axis, with respect to chuck 104. Preferably, three antirotation pins 106 are circumferentailly provided at equally spaced intervals of about 120° around the center of chuck 104. However, more or fewer antirotation pins may be used.

Antirotation pin 106 is slidably mounted within a bore 107 in chuck 104, to allow vertical movements of the antirotation pin with respect to the chuck. Antirotation pin 106 may be driven in a vertical direction upon tilting of substrate carrier 100 with respect to chuck 104. O-ring 109 provides a snug fit between antirotation pin 106 and bore 107 while still allowing pin 106 the freedom of vertical movement. Antirotation pin 106 is securely fixed in substrate carrier 100, preferably by threading into a threaded hole 118 of substrate carrier 100, although other equivalent methods of secure fixation may be employed.

A diaphragm 150 is seated atop bearing housing 105 and forms a seal therewith. Bearing housing 105 is further mounted to a vertical force applicator (not shown), which is preferably an air cylinder or hydraulic cylinder, which can be computer controlled for precise feedback control of the applied force. Piston column 120 is slidably mounted within bearing housing 105 via linear bearing 108. Pressure plate 112 is mounted to chuck 104 via screws preferably or bolts (not shown), and transfers downward vertical forces from the piston column 120 to the substrate carrier 100 via load cell 650 and contact pin 401. Air cylinder 122 mates with the underside of diaphragm 150 and contacts the upper end of piston column 120. Upon actuation of the vertical force applicator, diaphragm 150 distends, thereby transferring the vertical force to air cylinder 122 which in turn moves piston column 120 in a downward direction to apply vertical force to the substrate carrier 100 through pressure plate 112, load cell 650, contact pin 401 and button 402.

Antirotation pins 116 are mounted between pressure plate 112 and piston column 120, and piston column 120 and air cylinder 122, respectively, to substantially prevent rotation of the piston column 120 so as to limit application of forces to substantially normal downward translatory forces, thereby improving the accuracy of force measurement. Linear bearing 108 substantially reduces friction between the piston column 120 and bearing housing 105 during movement of the piston column 120 to transfer vertical forces, thereby greatly reducing hysteresis effects. Linear bearing 108 is mounted within bearing housing 105, preferably by mounting clamps 134, which are bolted to bearing housing 105 via bolts 136 or other equivalent mounting hardware.

Antirotation pins 124 are mounted between pressure plate 112 and bearing housing 105, and bearing housing 105 and air cylinder 122, respectively, to substantially prevent rotation of the pressure plate and air cylinder, which, in turn prevent rotation of the piston column 120 via antirotation pins 116, described above. Antirotation pins 124 are each slidably mounted within a bore 126 in bearing housing 105, to allow vertical movements of the antirotation pins 124 (as well as the air cylinder 122 and pressure plate 112) with respect to the bearing housing 105 during vertical movements of the piston column 120. O-rings 128 provide a snug fit between antirotation pins 124 and bore 126 while still allowing pins 124 the freedom of vertical movement. Antirotation pins 124 are securely fixed in air cylinder 122 and pressure plate 112, respectively, preferably by threading into threaded holes 130, although other equivalent methods of secure fixation may be employed.

The piston column and associated vertical force application hardware discussed above is designed for the application of downward force upon the substrate carrier 100 and, ultimately, the substrate to be polished/planarized. Accordingly, only a very small range of vertical displacement or travel is actually required by the piston column 120. At the beginning of a substrate conditioning procedure, it is preferred that the piston column 120 be located substantially in the middle of its range of vertical travel, to enable it to have the ability to move either upward or downward as needed. Sensor 160 is provided for providing reliable feedback as to the positioning of piston column 120 with respect to its vertical travel limits, thereby enabling the operator to position the piston column 120 at the center of its travel to begin processing.

Sensor 160 is fixedly mounted within a bore 162 in bearing housing 105, preferably by threading or other equivalent fixation. A feedback line (preferably an electrical connection) runs from the sensor to a controller (not shown) which interprets a feedback signal from the sensor 160 and converts the signal to a measurement of the position of piston column 120 with respect to its travel limits. Sensor 160 is preferably a linear voltage displacement transducer, although other equivalent sensors are available and may be used as a substitute. Sensor 160 includes travel probe 164 which slides in and out of the main housing of sensor 160 and generates a signal which is proportional to the amount of distance that the travel probe 164 extends from the main housing 161. The tip of travel probe 164 abuts against pressure plate 112. As piston column 120 moves either upward or downward, pressure plate 112, which abuts the piston column 120 moves with it, by an equal distance. Travel probe 164 directly measures the travel of pressure plate 112, which also provides an accurate measurement of the travel of piston column 120.

Figure 7:
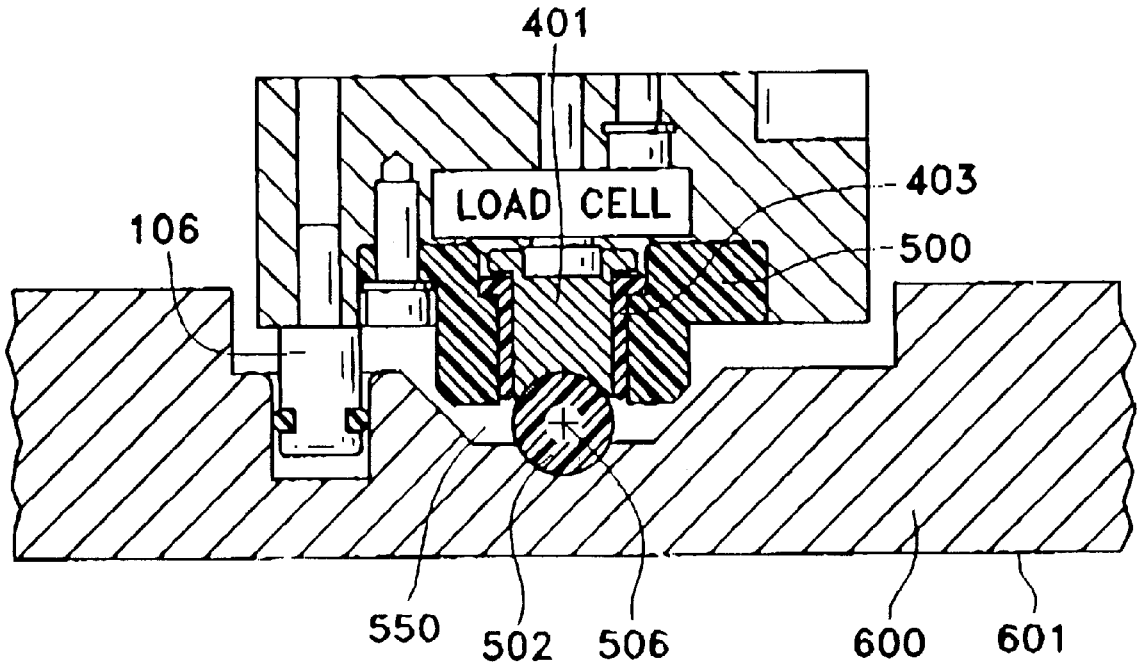
FIG. 7 is a sectional view of another of the preferred embodiments of a gimbal according to the present invention.

FIG. 7 shows another embodiment of an improved gimbal arrangement according to the present invention. Although this embodiment employs a full spherical gimbal ball, the pivot point is lower than a conventional gimbal system because of the advantages inherent in the substrate plate according to the present invention. Because the substrate plate 600 does not rotate, the substrate plate may be made hollow, thereby allowing gimbal ball 502 to be embedded within the substrate plate 600 at a much closer distance to the polishing surface than is conventional.

The pivot point of gimbal system 500 is defined by the point where horizontal and vertical forces intersect, i.e., the point defined by reference numeral 506 (the center of gimbal ball 502). Thus, the height or distance H affecting the moments formed in this system, although greater than the radius of the gimbal ball 502, is nevertheless significantly less than the thickness of the entire substrate plate 600, owing to the hollow design of the substrate plate 600 used in such a system.

Figure 8:
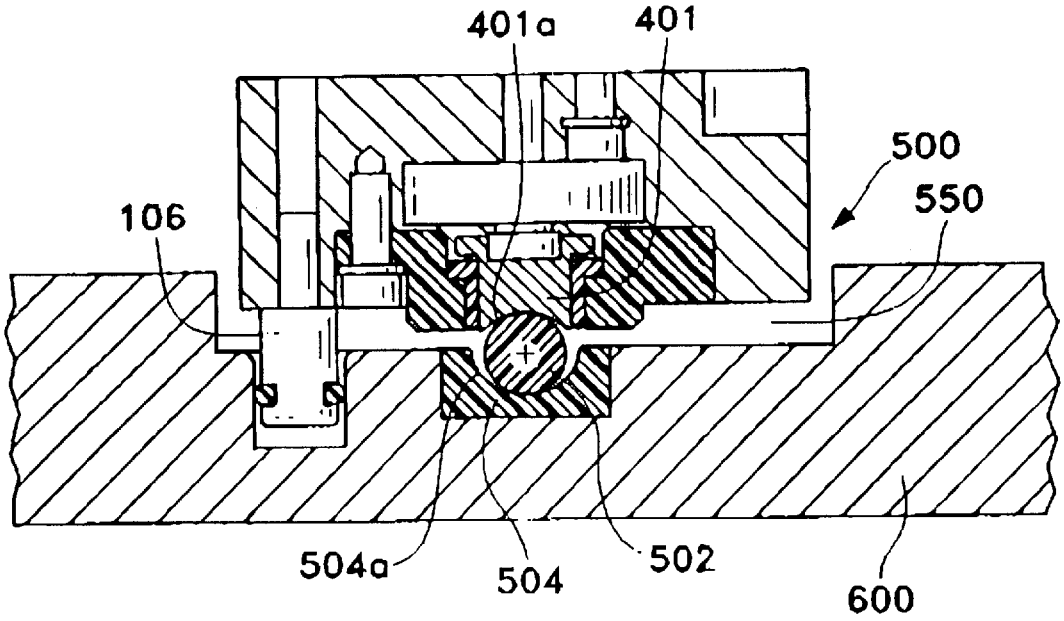
FIG. 8 is an enlarged cut-away sectional view of the puck and bearing surfaces of the gimbal shown in FIG. 7.

FIG. 8 is a sectional view of the embodiment shown in FIG. 7, which better shows the relationship between gimbal ball 502 and bearing surfaces 504*a* and 401*a*. The radii of curvature of the bearing surfaces 504*a* and 401*a* are substantially equal to one another and larger than the radius of curvature of gimbal ball 502. As the substrate carrier 100 is moved through a polishing pattern (preferably an orbital pattern, but an infinite number of patterns are available), the gimbal ball 502 being smaller than the socket defined by surfaces 504*a* and 401*a* rolls and precesses, much like the motion of a planetary gear or spirograph.

Because of the rolling ability of gimbal ball 502, this gimbal arrangement is not bound by the static friction inherent in a conventional gimbal ball pivot assembly, but rather experiences lower frictional forces in the form of rolling friction. Additionally, because of the lower positioning of gimbal ball 502 with respect to the polishing surface 601, significantly smaller moments are generated about the gimbal point during polishing, thereby significantly reducing the "nose-diving" phenomenon.

As further shown in FIG. 8, the bearing surface 504*a* is provided by the socket 504. Socket 504 is fixed, preferably press fit, within the hollow portion of substrate plate 600. Of course, other equivalent methods of fixing the socket 504 into the substrate plate may be used, such as the use of adhesives, screws, friction welding, etc. Socket 504 is preferably formed of DELRIN, or another substantially equivalent linear acetyl resin. Other suitable low friction plastics include polyphenko ertalyte. Still further, other low friction materials such as ceramics may be successfully employed. Additionally, socket 504 may be made of metal such as stainless steel, aluminum, brass, etc., and coated with one of the aforementioned plastics or ceramics to form the bearing surface 504*a*. As in the previously discussed embodiment, the substrate plate 600, puck 500 and contact pin 401 are preferably formed of stainless steel, more preferably hardened stainless steel, but other metals having sufficient strength and wear resistance, such as aluminum or brass, for example, may be alternatively used. However, in this embodiment, the contact pin includes a bearing surface 401*a* which interfaces with gimbal ball 502. Bearing surface 401*a* is preferably formed of the same material as bearing surface 504*a*.

The arrangement of one or more antirotation pins 161 is also provided with this embodiment and is the same as described above with respect to the embodiment shown in FIG. 5. The puck 500 and upper portion of the hollow in substrate plate 600 define a socket 550 which is preferably filled with grease or other lubricant to further reduce the rolling friction experienced by gimbal ball 502 during gimballing.

Figure 9:
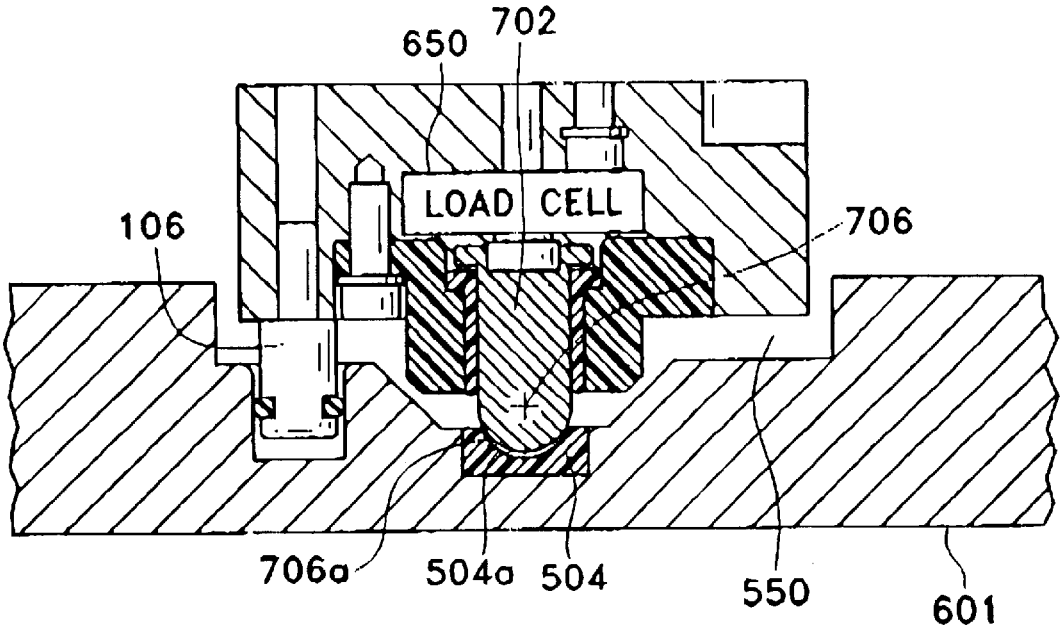
FIG. 9 is a sectional view of a third preferred gimbal arrangement according to the present invention.

FIG. 9 shows another embodiment of an improved gimbal apparatus according to the present invention. This embodiment shares the low profile advantages discussed above with regard to the embodiment shown in FIGS. 7 and 8, i.e., because of the lower positioning of the gimbal point 706 with respect to the polishing surface 601, significantly smaller moments are generated about the gimbal point during polishing, thereby significantly reducing the "nose-diving" phenomenon.

The socket 504 and bearing surface 504*a*, as well as the arrangement of one or more antirotation pins 106, and grease socket 550 are also provided with this embodiment and are the same as described above with respect to the embodiment shown in FIGS. 7 and 8. This embodiment differs, however, in that the gimbal ball 502 and contact pin 401 of FIG. 8 have been integrated into one component 702. This eliminates the bearing interface between bearing surface 401*a* and gimbal ball 502 in the previous embodiment. The effect of this arrangement is that contact pin 702 does not roll as effectively as gimbal ball 502. However, this embodiment has the advantage of reducing a certain amount of vibration during polishing processes. Friction reduction is achieved, with regard to conventional gimbal arrangements, by the provision of bearing surface 504*a* having a larger radius of curvature than the radius of curvature of the end of contact pin 706*a*. Contact pin 706 and end 706*a* are preferably formed of hardened stainless steel, or other equivalent metals as discussed above with regard to other embodiments of gimbal balls and contact pins.

A load cell 650 is provided directly above contact pin 706 to achieve the same direct feedback benefits as described above with regard to load cells used in other embodiments of the present invention.

The foregoing detailed description is illustrative of several embodiments of the invention, and it is to be understood that additional embodiments thereof will be obvious to those of ordinary skill in the art. Those modifications and equivalents which fall within the spirit of the invention are to be considered a part thereof.

What is claimed is:

1. A low profile, low hysteresis force feedback gimbal system comprising:

a plate having a substantially hollow portion on an upper side thereof;

a first bearing surface located within said hollow portion on said plate;

a chuck to which said plate is mounted;

a force applicator operable through said chuck, for application of a down force to said plate;

a contact pin for transferring said down force to said plate;

a second bearing surface associated with said contact pin for transferring said down force from said contact pin, to said first bearing surface and said plate; and a load cell mounted directly above said contact pin, between said contact pin and said force applicator, said load cell capable of providing a substantially hysteresis free force feedback measurement of said down force applied to said plate.

2. The gimbal system of claim 1, wherein said first and second bearing surfaces allow said plate to pivot with respect to said chuck, wherein said plate further comprises a lower side and a thickness defined by a distance between said upper and lower sides, and wherein said gimbal system defines a pivot point about which said plate pivots with respect to said chuck, said pivot point located at a distance from said lower side of said plate which is less than said thickness.

3. The gimbal system of claim 2, further comprising at least one antirotation pin mounted between said chuck and said plate, said at least one antirotation pin substantially preventing rotation of said plate with respect to said chuck, without substantially restricting said pivoting of said plate.

4. The gimbal system of claim 1, wherein said first bearing surface comprises a first radius of curvature and said second bearing surface comprises a second radius of curvature, said first radius of curvature being greater than said second radius of curvature.

5. The gimbal system of claim 4, wherein said second bearing surface is mounted on an end of said contact pin.

6. The gimbal system of claim 4, wherein said second bearing surface comprises a gimbal ball, said gimbal system further comprising a third bearing surface mounted on an end of said contact pin and having a radius of curvature substantially equal to said first radius of curvature, wherein said gimbal ball rolls with respect to said first and third bearing surfaces during pivoting of said plate.

7. The gimbal system of claim 1, further comprising:

a puck surrounding said contact pin, said puck having a third bearing surface comprising a horizontal contact bearing surface in horizontal alignment with said second bearing surface; and a fourth bearing surface mounted in said substantially hollow portion of said plate.

8. The gimbal system of claim 7, further comprising:

a low friction sleeve between said contact pin and said puck enabling said contact pin to slide substantially friction free with respect to said puck, to transfer vertical forces from said force applicator to said first bearing surface with substantially no transfer of said vertical forces to said horizontal contact bearing surface.

9. The gimbal system of claim 7, wherein said first, second, horizontal contact and fourth bearing surfaces allow said plate to pivot with respect to said chuck, said second bearing surface pivoting on said first contact surface, and said horizontal contact surface pivoting on said fourth bearing surface;

wherein said plate further comprises a lower side and a thickness defined by a distance between said upper and lower sides;

wherein said contact between said first and second bearing surfaces occurs at a first pivot distance from said lower side which is substantially equal to a second pivot distance defined by the distance of said contact between said horizontal contact surface bearing and fourth surface bearing from said lower side; and wherein said first and second pivot distances are each less than said thickness.

10. The gimbal system of claim 9, further comprising at least one antirotation pin mounted between said chuck and said plate, said at least one antirotation pin substantially preventing rotation of said plate with respect to said chuck, without substantially restricting said pivoting of said plate.

11. The gimbal system of claim 7, wherein said first bearing surface comprises a first radius of curvature and said second bearing surface comprises a second radius of curvature, said first radius of curvature being greater than said second radius of curvature; and wherein said horizontal contact bearing surface comprises a third radius of curvature and said fourth bearing surface comprises a fourth radius of curvature, said fourth radius of curvature being greater than said third radius of curvature.

12. The gimbal system of claim 11, wherein said third radius of curvature is substantially equal to said second radius of curvature.

13. A low profile, low hysteresis force feedback gimbal system comprising:

a dual radius gimbal bearing including a vertical bearing surface characterized by at least a portion of a sphere, for transferring vertical forces through the gimbal system, and at least one horizontal bearing surface for transferring horizontal force components through the gimbal system, wherein said vertical and horizontal bearing surfaces are substantially horizontally aligned in a plane within said dual radius gimbal bearing.

14. The gimbal system of claim 13, wherein said dual radius gimbal bearing further comprises:

a contact pin on which said vertical bearing surface is mounted; and a puck surrounding said contact pin, said at least one horizontal bearing surface being mounted on said puck.

15. The gimbal system of claim 14, further comprising:

a load cell mounted on said contact pin.

16. The gimbal system of claim 13, further comprising:

a substrate plate for application of force to a substrate to effect polishing, said substrate plate having a lower surface, an upper surface opposite said lower surface, and a thickness defined by a distance between said lower surface and said upper surface, said dual radius gimbal bearing being mounted on said substrate plate.

17. The gimbal system of claim 16, wherein said substrate plate further includes a hollow portion opening on said upper surface and said dual radius gimbal bearing is mounted in said hollow portion so that a distance between said vertical bearing surface and said lower surface is less than said thickness and further so that a distance between said at least one horizontal bearing surface and said lower surface is less than said thickness and substantially equal to said distance between said vertical bearing surface and said lower surface.

18. The gimbal system of claim 17, further comprising:

a contact button formed on a bottom surface of said hollow portion, said contact button abutting said vertical bearing surface.

19. The gimbal system of claim 17, further comprising:

at least one bearing surface formed on a side wall of said hollow portion, said at least one bearing surface abutting said at least one horizontal bearing surface.

20. The gimbal system of claim 19, wherein said at least one bearing surface comprises a low friction bearing ring formed circumferentially on said side wall of said hollow portion.

21. The gimbal system of claim 16, further comprising:

a chuck to which said substrate plate is mounted, said dual radius gimbal bearing being mounted between said substrate plate and said chuck.

22. The gimbal system of claim 21, further comprising:

at least one antirotation pin mounted between said chuck and said substrate plate, said at least one antirotation pin substantially preventing rotation of said substrate plate with respect to said chuck, without substantially restricting pivoting of said substrate plate via said dual radius gimbal bearing.

* * * * *

UNITED STATES PATENT AND TRADEMARK OFFICE

CERTIFICATE OF CORRECTION

PATENT NO. : 5,899,798

DATED : May 4, 1999

INVENTOR(S) : Daniel R. Trojan, et al

It is certified that error appears in the above-indentified patent and that said Letters Patent is hereby corrected as shown below:

The drawing, consisting of Fig. 7, should be deleted to be replaced with the drawing sheet, consisting of Fig. 7, as shown on the attached page.

Signed and Sealed this

Twelfth Day of October, 1999

*Attest:*

Q. TODD DICKINSON

*Attesting Officer*

*Acting Commissioner of Patents and Trademarks*

UNITED STATES PATENT AND TRADEMARK OFFICE

CERTIFICATE OF CORRECTION

PATENT NO. :5,899,798

DATED :May 4, 1999

INVENTOR(S) :Daniel R. Trojan, et al

It is certified that error appears in the above-indentified patent and that said Letters Patent is hereby corrected as shown below:

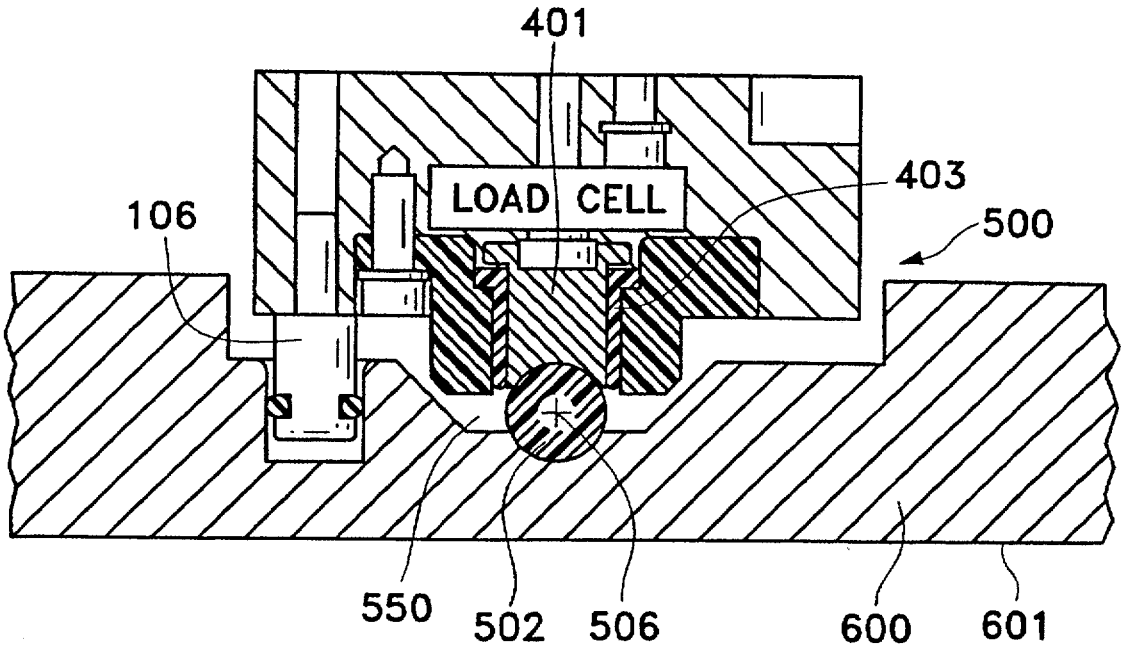

FIG. 7